United States Patent [19]

Hecht et al.

[11] Patent Number: 4,553,713

[45] Date of Patent: Nov. 19, 1985

[54] COIL WINDING CONTROL GUIDE

[75] Inventors: Richard M. Hecht, Chicago; Robert G. Seaverns, Northbrook, both of Ill.

[73] Assignee: Gasway Corporation, Chicago, Ill.

[21] Appl. No.: 506,301

[22] Filed: Jun. 21, 1983

[51] Int. Cl.[4] ..... B65H 23/16

[52] U.S. Cl. ..... 242/78.1; 242/75.3

[58] Field of Search ..... 242/75.3, 75, 155 R, 242/157.1, 157, 76, 67.1 R, 78.1; 308/3 R

[56] References Cited

U.S. PATENT DOCUMENTS

| | | | |
|---|---|---|---|
| 58,708 | 10/1866 | Wolf | 242/75.3 X |
| 1,929,087 | 10/1933 | Wood | 242/75.3 |
| 2,050,053 | 8/1936 | Graf et al. | 242/75.3 X |
| 2,570,929 | 10/1951 | Fitch et al. | 242/76 X |
| 2,738,161 | 3/1956 | Chupp | 242/157.1 |
| 3,115,696 | 12/1963 | Evans | 308/3 R X |
| 3,249,315 | 5/1966 | Peltier | 242/75.3 |
| 3,468,529 | 9/1969 | Martin et al. | 242/68.7 X |
| 3,486,713 | 12/1969 | Freiman | 242/155 R |
| 3,588,388 | 6/1971 | Harris | 242/155 R X |
| 3,968,187 | 6/1976 | Ohi | 242/75 X |
| 4,264,112 | 4/1981 | Magnuson | 308/3 R |
| 4,283,024 | 8/1981 | Sienkiewicz | 242/75.3 |
| 4,293,108 | 10/1981 | Randel | 242/75.3 |

*Primary Examiner*—Stephen Marcus
*Assistant Examiner*—Leo J. Peters
*Attorney, Agent, or Firm*—Laff, Whitesel, Conte & Saret

[57] ABSTRACT

A guide roller for aligning successive turns on a coil of a ribbon-like web. The guide roller automatically positions itself to maintain a uniform clearance space between the incoming web and the circumferential periphery of the coil. The clearance space is provided to prevent a marring of a coating on the surface of web material. As the coil radius increases during the winding process, the guide roller maintains a constant and uniform clearance space responsive to the changing angle between the incoming and outgoing web passing over the guide roller.

5 Claims, 8 Drawing Figures

COIL WINDING CONTROL GUIDE

Reference is made to my copending application entitled HUB LOCK FOR COIL FORMER SUPPORT MEANS, Ser. No. 506,300, filed June 21, 1983, which shows another aspect of the same system.

This invention relates to machines for winding a web of ribbon-like metal into coils especially—although not exclusively—in order to provide a supply of coated, but uncured, metal stock that may later be used during future manufacture.

Stock metal coating is a modern, high speed production process for applying smooth films of lacquers, paints, varnishes, adhesives, strippable films or almost any other coating material to work pieces, which are flat or moderately curved. It uses a flow coating principle of passing a work piece through a continuous falling stream of liquid coating material, which is accurately controlled in thickness and rate of flow so that there is no excess runoff.

The surface of a work piece passing through the process is coated uniformly and continuously, piece after piece, at high production rates. This is accomplished by flowing a uniformly distributed coating material over a weir or dam. The coating material then drops under gravity from a skirt of the weir, either onto the work piece or into a gutter which returns the coating material to the reservoir to be recirculated.

An example of such a machine is one for coating a ribbon-like web which is later used in further manufacture of the slats of a venetian blind. A rolling mill, or the like, produces a long and continuous ribbon of metal which is wound upon a spindle to form a supply reel. That supply reel may then be transferred to any other suitable machine for further processing, in this case for applying a surface coating. After the coating, any suitable further manufacturing steps may be carried out. For example, a coil of coated venetian blind slat stock may be cut off the coated coil at any discrete length, and punched to provide openings for enabling a passage of the venetian blind control ropes.

The problems with coiling coated metal stock of this type relate to a need for preserving an unmarred surface on the coating material at a time when the coating has not yet necessarily had time for complete curing. Thus, for example, if the slat stock is spray painted, it may be dry to the touch; however, there could still be enough solvents in the "dry" paint to migrate from turn to turn within the coil and combine to prevent an unwinding of the coil which leaves an unmarred surface. Other problems could also occur such as surface scratching if successive turns of the coil are cinch up tightly or if they are so loose that they rub over each other within the coil.

Therefore, there is a need to guide the coated ribbon stock onto the coil and to keep the successive turns in alignment. As the successive turns are laid down, each adds some degree of radial tension within the coil. The tension of all of the successive turns are additive so that the center coil tends to cinch-up tighter and tighter as the diameter of the coil increases. This cinching mars the surface. Therefore, a guide must be provided for laying down the successive turns of the coil in order to avoid surface marring while accommodating the varying tensions.

Accordingly, an object of the invention is to provide new and novel means for and methods of aligning successive turns of the winding coils. In particular, an object is to wind the coil in a manner which does not mar a coated surface on the coil stock. Here, an object is to guide the stock and enable the successive turns to be laid down as the coil is wound with an ever increasing diameter.

Another object of the invention is to provide a self-seeking, guiding system which lays down the successive turns in alignment despite the continuously changing coil diameter. Here, an object is to provide a guiding system which always seeks an equilibrium of balance forces, wherein the tensions of stock being wound into a coil come into balance and that balance correctly positions the guide.

In keeping with an aspect of the invention, these and other objects are accomplished by a floating guide roller which is always suspended near, but not touching, the outside diameter of a coil. As the coil diameter grows, while it is wound, the floating guide roller is subjected to a number of vector forces which are produced by the tension in a running web of the coated metal and by the angle between the roller and a tangent to the instantaneous coil diameter. The resultant vectors always bring the guide roller to and maintains it at the desired position near, which is near, but not touching, the outermost turn on the coil.

A preferred embodiment of this invention is shown in the attached drawing, wherein.

Figure 3:
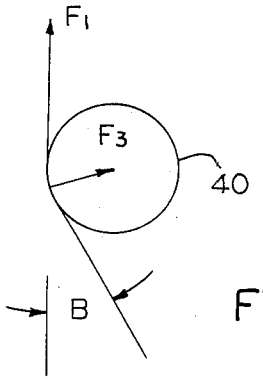
Figure 4:
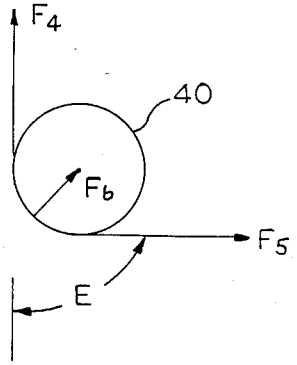
Figure 5:
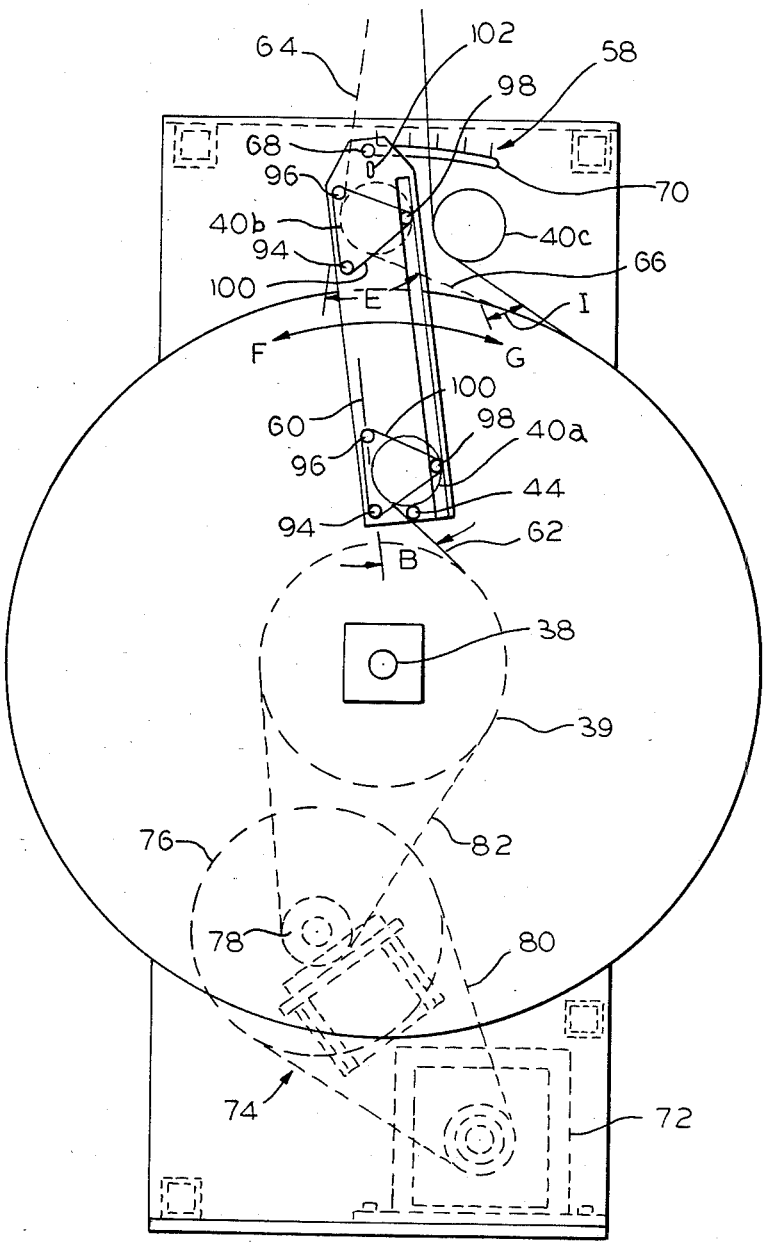
Figure 6:
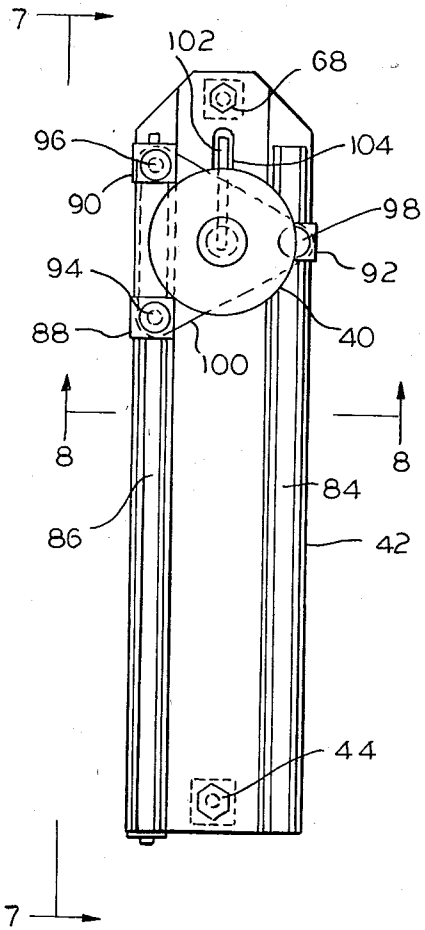
Figure 7:
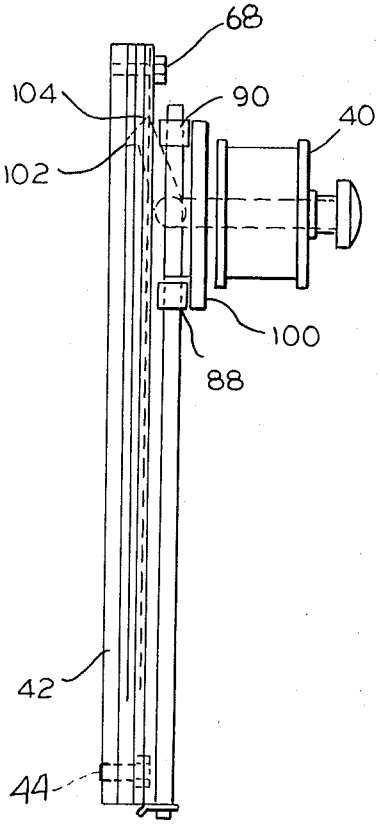

FIG. 3 graphically shows a force diagram which positions a floating guide roller at the start of a coil winding operation;

FIG. 4 is a similar force diagram showing how the guide roller is positioned at the end of a coil winding operation;

FIG. 5 is a plan view showing construction details of the inventive self-seeking and floating guide roller;

FIG. 6 is a detail view of the floating guide roller, and its supporting structure;

FIG. 7 is a side elevation taken along line 7—7 of FIG. 6; and

Figure 8:
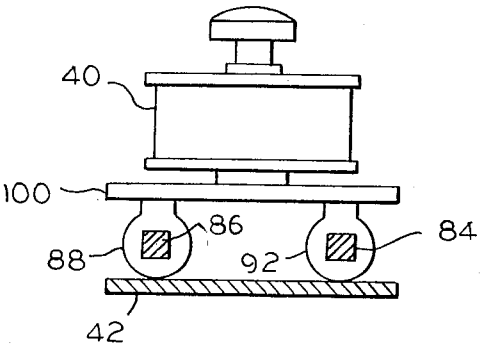

FIG. 8 is an end view (partly in cross section) taken along line 8—8 of FIG. 6.

Figure 1:
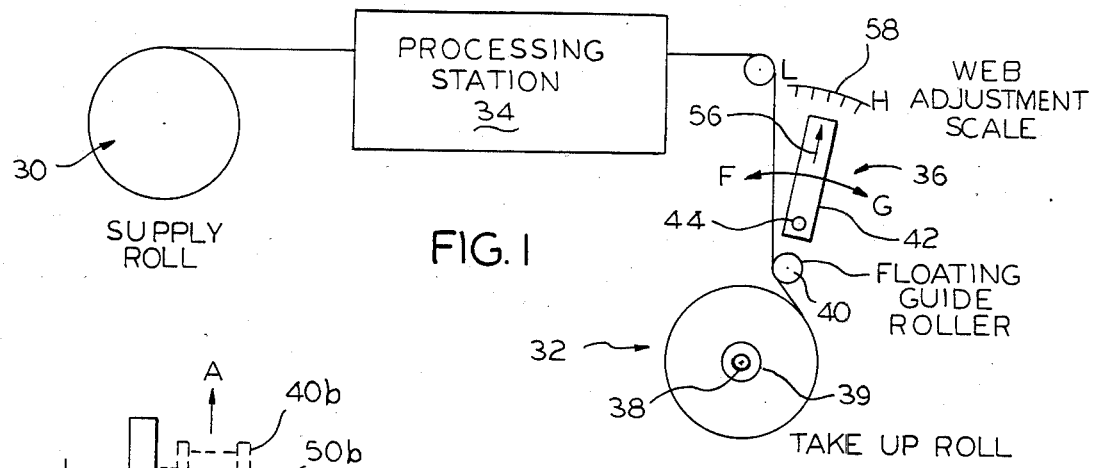
FIG. 1 is a schematic view of a coil winding and rewinding system with the inventive guide roller being held in place.

The metal coating and coiling system of FIG. 1 includes a supply roll 30, a take-up roll 32, a metal coating processing station 34, and the inventive floating guide roller and its support system 36. The supply roll 30, symbolically represents any suitable source of stock material. Here, it is assumed to be a metallic web or ribbon-like material which has previously been wound into a supply roll. It could also be the output of a metal rolling mill, or any other suitable supply. In the example of venetian blind slat stock, supply roll 30 would be a spool of a thin aluminum ribbon which is about an inch or two wide and a few mils thick.

The processing station 34 supplies any suitable surface coating to the web of metal stock, as it is pulled from the supply roll 30. In the example of a venetian blind slat, station 34 supplies a coat of enamel or lacquer which completely covers and encases the aluminum ribbon. The take-up roll 32 is a coil which is being wound on a spindle 38, having a hub former 39 mounted thereon. The coil 32 may have any suitable beginning diameter which may be as small as the diameter of spindle 38 or former 39 mounted on the spindle. The ending and ultimate diameter of the coil may be quite large, by comparison.

According to the invention, a floating guide roller 40 always remains near, but not touching, the growing outside diameter or circumferential perimeter of the coil, being formed on the take-up roll 32. This roller aligns the successive turns of the web of metal ribbon as they are being laid down on the coil.

Figure 2:
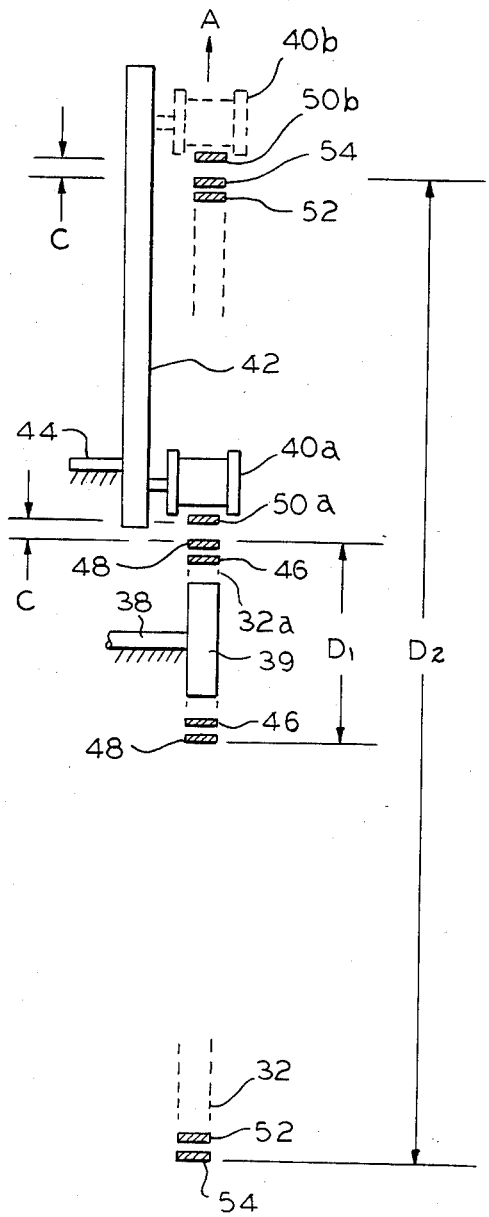
FIG. 2 is a side elevation view of a floating guide roller and associated portions of the structure of FIG. 1.

Briefly, the guide roller 40 is mounted on a lever or arm 42 which is pivotly connected at point 44 to any suitable support frame (not shown). The lever or arm 42 sits on one side of the take-up roll 32 so that the expanding coil may grow in front of the arm, as shown in FIG. 2.

In greater detail, the guide roller 40 is shown in solid lines near the lower end of arm 42, at the beginning of a coil formation. The starting diameter coil D1 is not much larger than the diameter of a core or former 39 mounted on spindle 38. The last two circumferential peripheral turns of the small diameter starting coil 32*a* are shown at 46, 48. The coated web 50 is here shown as being guided by the floating roller in position 40*a* so that each succeeding turn is correctly aligned, as turns 46, 48 are here shown to be aligned.

The web 50*a* passing under the guide roller in position 40*a* is separated from the outer turn 48 of the beginning coil 32*a* by a clearance distance C. There, roller 40*a* is close enough to insure alignment of the successive turns, but far enough to prevent the web 50 from touching outer turn 48. As the coil 32 grows its diameter continuously becomes larger, until it reaches some maximum D2, as shown at 32*b*. Here, the outer two circumferential peripheral turns of the large diameter ending core are numbered 52, 54. The original, relatively small beginning diameter D1 (shown in FIG. 2) of coil 32*a* has grown to become a relatively large ending diameter D2 of coil 32*b*. In one example, beginning diameter D1 is about four inches and ending diameter D2 is about forty inches.

As the diameter of coil 32 increases, a mounting for the guide roller 40 slides up (direction A) the lever or arm 42 to the position 40*b*, shown by dashed lines. At each instantaneous position along the length of lever or arm 42, the clearance space C remains substantially the same, as here shown between the running web 50 and the outermost turn 48 or 54.

The instantaneous position of the support for the guide roller 40 (and therefore the clearance space C) is determined by the resultant of the various vector forces acting on it. FIG. 3 illustrates three forces F1, F2 and F3, which occur at the small diameter beginning coil. Force F1 represents the total tension in the incoming web 50 before it reaches roller 40. Force F2 represents the total tension in the outgoing web after it leaves roller 40 and before it reaches the coil 32. Force F3 is the resultant force acting on roller 40. The angle B is the angle of the outgoing (force F2) with respect to the incoming web (force F1). Thus, angle B is set by the relatively small diameter D1 (FIG. 2) of the beginning coil, at the start of winding. Angle B is in the order of 15° to 20° in one exemplary system. Or, stated another way, the incoming and outgoing web stock almost form a straight line.

In the large diameter ending coil (FIG. 4), force F4 represents the tension in the incoming web. Force F5 is the tension in the outgoing web. Force F6 is the resultant force acting on the guide roller 40. The relatively large angle E (FIG. 4) is the angle of the outgoing web relative to the incoming web (force F4). The angle E may be in the order of 75°–80°. Or, stated another way, the angle between the incoming and outgoing web stock approaches a right angle. This change between the beginning and ending angles B and E occurs because the diameter of the coil grows larger. The change in angle causes the floating guide roller 40 to move in direction A, along the lever or arm 42. Thus, the guide roller 40 assumes a position which is dictated by the force vectors acting upon it and by the web angle extending from the guide roller to the coil surface.

The forces acting on the roller also change as a function of the strength of the material forming web 50. The above cited example of venetial blind slat stock may be relatively lighweight aluminum with a low resistance to bending. Or, in another example, it could be another and relatively heavy material, such as stainless steel stock with a high resistance to bending. Therefore, the angles B and E between the web and a tangent to the circumference of the coil surface change as a function of the web material.

Accordingly, when the coil winding machine is originally set up, the position of the lever or arm 42 is moved about pivot point 44 in the directions F, G to a selected position between limits marked "L" and "H" ("Light" and "Heavy") in FIG. 1. A pointer 56 on the arm 42 may be set to any indication encircled on a scale 58. Conveniently, the scale might be marked in the physical terms of the stock, as for example, "1 AL 64", meaning aluminum which is one inch wide and 1/64-inch thick.

Once the position of lever or arm 42 is set and locked, the guide roller 40 automatically follows the expanding diameter of coil 32 as it is wound.

The actual structure of the invention is seen in FIGS. 5–8, where the same reference numerals are used to identify the parts which have already been described. The guide roller 40 preferably made of an ultra-high molecular weight polyethelene material because it is long wearing and has a relatively soft surface which does not mar the web. This material is currently available from any well-stocked distributor of plastic material. The guide roller is shown in FIG. 5 in three positions: 40*a* at the start of winding; 40*b* at the end of winding in a light weight web stock position; and 40*c* at the end of winding in the heavy weight web stock position.

When the guide roller is in the lower position 40*a*, there is a small angle B, between the input and output web positions 60, 62, respectively. When the guide roller is in the upper (dashed line) position 40*b*, there is a large angle E between the input and the output web positions 64, 66 respectively.

In FIG. 5, the arm 42 is shown in the light stock position since bolt 68 is tightened in the extreme left-hand end of an arcuate slot 70 centered on pivot point 44.

If a heavy stock is run, bolt 68 is loosened and arm 42 is swung to some point indicated on scale 58. For the heaviest stock that can be accommodated, the arm 42 reaches the extreme right hand end of slot 70 where bolt 68 is tightened and the arm 42 is locked in position. In that position, the guide roller reaches the ending position 40*c* and the angle E changes to a somewhat smaller angle I, at the upper end of the arm 42.

An electric motor 72 drives the spindle 38 via a suitable speed control system 74 which converts the rotational speed of motor 72 to a desired rotational speed of the spindle. In this embodiment, the speed control system 74 includes a plurality of pulleys 76, 78 having different diameters with belts 80, 82 trained around them.

The structure of guide roller 40, its support, and arm 42 is shown in FIGS. 6, 7, 8, where the roller is in the ending, large coil diameter position. A pair of spaced parallel guide rails 84, 86 are bolted or otherwise attached to a metal plate, to support three linear bearings 88, 90, 92. The guide rails 84, 86 and linear bearings 88, 90, 92 may be a product sold under the trademark "NYGLIDE" by Precision Laminations, a company located in Rockford, Ill. In this form, the linear bearings have steel guide rails 84, 86 with square or rectangular cross section and nylon bearing blocks 88, 90, 92, each having therein a window with a cross section corresponding to the cross section of the rails 84, 86. This form of bearing has an extremely low sliding friction.

The three bearings 88, 90, 92 are attached to a triangular plate 100 by screws 94, 96, 98.

The guide roller 40 is rotatably mounted on plate 100. Thus, the guide roller mounting plate 100 is moved longitudinally along guide rails 84, 86 responsive to the resultant forces acting on the guide roller, as shown in FIGS. 3 and 4.

It should now be apparent that the guide roller has a self-seeking capability whereby it is automatically moved to any position along the length of arm 42, which position represents the resultant of vector forces acting as a roller as shown in FIGS. 3, 4. The resultant, in turn, varies with the angle B, E (or I) formed by the incoming web, the outgoing web, and a tangent to the circumference at the instantaneous outside diameter of the coil. Thus, the guide roller automatically follows the increasing diameter of the coil without requiring sensors, servo mechanisms, or the like.

In operation, the guide 40 is latched to plate 42, at 102 (FIG. 7), in a raised position. The bolt or screw 68 may be loosened, arm 42 moved to a position selected for a particular stock, and the screw 68 is tightened to lock it into position. The former 39 (FIG. 5) may preferably be a low cost plastic hub, which is slipped over spindle 38 and locked into position.

The web 60 is brought in and under roller 40*a*, where the web end is either taped to the former 39 or inserted into a slot in the former. Then, the former 39 is rotated several times so that the web takes a few turns upon itself to lock it into position and form the beginning coil.

A motor is energized and the coil is wound. The guide roller 40 guides and directs the web into tangential alignment with the circumference of the coil. The guide roller raises automatically as the coil diameter increases, thereby maintaining the tangential alignment of the web, throughout the winding. When the coil is complete, the guide roller is at the top of the arm 42. The latch 102 drops into hole 104. A linear footage counter detects when a desired length of the web has been wound on the coil, and then power is removed from motor 72. The coil winding stops and the ending coil is unloaded by removing former 39 from the spindle 38.

Those who are skilled in the art will readily perceive how to modify the invention. Therefore, the appended claims are to be construed to cover all equivalent structures which fall within the true scope and spirit of the invention.

The claimed invention is:

1. A guide system for a web which is wound into a coil having an increasing diameter, said guide system comprising an elongated generally vertical supporting arm extending across and adjacent an approximate radius of said coil, linear bearings comprising at least one guide rail extending longitudinally along the length of said support arm and at least one sliding bearing riding on said guide rails, rotatable guide roller means mounted on said sliding bearing for guiding and directing a web onto said coil in tangential alignment with the circumference thereof, the incoming web entering from a point above the supporting arm and moving down and under the guide roller and the outgoing web leaving the guide roller to be wound on the circumference of a coil which is below the guide roller, said incoming and outgoing web forming an obtuse angle which varies as a function of the instantaneous diameter of the coil, and means responsive to tension in the web applied to said guide roller along the sides of said angle for positioning said guide roller along said supporting arm so that said varying obtuse angle continuously urges said sliding bearing to a position which maintains the position of said guide roller at a substantially constant distance from the periphery of said coil as said diameter increases.

2. The system of claim 1 wherein there are at least two of said guide rails in a spaced parallel relationship and there is at least one sliding bearing riding on each of said guide rails, and a plate mounted on and supported by said sliding bearings, said guide roller means being rotatably mounted on said plate.

3. A guide system for a web which is wound into a coil having an increasing diameter, said guide system comprising an elongated supporting arm extending across and adjacent an approximate radius of said coil, linear bearings comprising at least two guide rails in spaced parallel relationship extending longitudinally along the length of said support arm and at least one sliding bearing riding on each of said guide rails, a plate mounted on and supported by said sliding bearing, rotatable guide roller means rotatably mounted on said plate for guiding and directing a web onto said coil in tangential alignment with the circumference thereof, latch means associated with said plate for latching said guide roller mounting means at one end of said elongated supporting arm, the incoming web entering upon the guide roller and the outgoing web leaving the guide roller forming an angle which varies as a function of the instantaneous diameter of the coil, and means responsive to tension in the web applied to said guide roller along the sides of said angle for positioning said supporting arm so that said varying angle continuously urges said sliding bearing to a position which maintains the position of said guide roller at a substantially constant distance from the periphery of said coil as said diameter increases.

4. The system of claim 1 and means for pivotally mounting said support arm for varying its position with respect to said approximately radius, whereby the angle between the incoming and outgoing web may be selected.

5. The system of claim 4 and scale means for identifying the position of said support arm in terms of the physical characteristics of said web.

* * * * *